US007043181B2

(12) United States Patent
Fujishima et al.

(10) Patent No.: US 7,043,181 B2
(45) Date of Patent: May 9, 2006

(54) DEVELOPING APPARATUS AND METHOD FOR REGULATING AN AC BIAS FREQUENCY TO THE DEVELOPING ROLLER

(75) Inventors: Masashi Fujishima, Osaka (JP); Shoichi Sakata, Osaka (JP)

(73) Assignee: Kyocera Mita Corporation, Oska (JP)

( * ) Notice: Subject to any disclaimer, the term of this patent is extended or adjusted under 35 U.S.C. 154(b) by 0 days.

(21) Appl. No.: 10/814,825

(22) Filed: Apr. 1, 2004

(65) Prior Publication Data

US 2004/0228661 A1 Nov. 18, 2004

(30) Foreign Application Priority Data

Apr. 4, 2003 (JP) ..... 2003-102039

(51) Int. Cl.
*G03G 15/08* (2006.01)

(52) U.S. Cl. ..... 399/279; 399/285

(58) Field of Classification Search ..... 399/279, 399/267, 270, 55, 285, 286
See application file for complete search history.

(56) References Cited

U.S. PATENT DOCUMENTS 4,334,772 A * 6/1982 Suzuki ..... 399/145
4,380,966 A 4/1983 Isaka et al.
5,999,782 A * 12/1999 Iguchi et al. ..... 399/270
6,522,854 B1 * 2/2003 Nishiuwatoko ..... 399/267
2002/0018672 A1 * 2/2002 Ozawa et al. ..... 399/270
2003/0049054 A1 3/2003 Ozawa et al.
2003/0202825 A1 * 10/2003 Yamada et al. ..... 399/279

FOREIGN PATENT DOCUMENTS

| | | |
|---|---|---|
| JP | 3-14192 | 2/1991 |
| JP | 6-67546 | 3/1994 |
| JP | 7-92804 | 4/1995 |
| JP | 2003-107898 | 4/2003 |

* cited by examiner

*Primary Examiner*—Arthur T. Grimley
*Assistant Examiner*—Ryan Gleitz
(74) *Attorney, Agent, or Firm*—Smith, Gambrell & Russell

(57) ABSTRACT

The electrophotographic image formation apparatus of the present invention adopts a developer roller, which is made of aluminum and has an aluminum oxide film of at least 5 μm in thickness formed on surface thereof. In the image formation apparatus, a gap between the developer roller and a photoreceptor drum 3 is set in a range of 150 to 300 μm. The image formation method of the present invention regulates a frequency of AC voltage in a non-development state to be higher than that in a development state, when an AC voltage is applied onto the developer roller to cause flight of toner from the developer roller to the photoreceptor, and selectively makes charged toner fly onto the electrostatic latent image for development. The present invention provides the effective development technique to prevent leakage of the applied voltage between the developer roller and the photoreceptor drum.

5 Claims, 2 Drawing Sheets

DEVELOPING APPARATUS AND METHOD FOR REGULATING AN AC BIAS FREQUENCY TO THE DEVELOPING ROLLER

BACKGROUND OF THE INVENTION

The present invention relates to an image formation apparatus, and an image formation method using the same. The image formation apparatus may be any of photocopiers, printers, facsimiles, and composite machines based on the electrophotographic technique. More particularly, the present invention relates to a non-contact development-type image formation apparatus with a two-component developer containing magnetic carrier particles and nonmagnetic toner, and an image formation method using the same. In this image formation apparatus, the nonmagnetic toner is charged by the magnetic carrier. Only the charged toner is kept on a developer roller and is flown onto an electrostatic latent image for development.

There are known image formation apparatuses with the two-component developer, so-called hybrid development apparatus, as disclosed in, for example, Japanese Published Unexamined Patent Application (Kokai Tokkyo Koho) no. 6-67546 and No. 7-92804. This development apparatus has a developer roller opposed to an image holder having an electrostatic latent image and a magnetic roller which is put on the opposite place of the image holder on the developer roller, detached from the developer roller. Applicability of such image formation apparatuses to one-drum color overlay technique, which successively forms multiple image formation portions comprising a charging unit and an exposure optical unit and so on corresponding to multiple color image on a photoreceptor, has been examined with the recent demand for high-speed image processing. According to this image formation apparatus, it is possible to form a color image with no significant color shift because of accurate overlay of multiple toners on the photoreceptor. Therefore, the potential of this technique for the high-quality color imaging has been thus been noted. Further, this color image forming apparatus is noted since said two-component development system does not disturb a toner image that is formed by an image forming portion for other colors.

Another proposed technique for high-speed color imaging is a tandem system that uses multiple photoreceptors according to respective color toners and successively forms respective color component images in an overlapping manner on a transfer medium in synchronism with a feed of the transfer medium. In the tandem system, said two-component development system is noted as a non-contacting developing system which does not afford excessive stress to a photoreceptor drum.

In the known two-component development system, however, the presence of non-developed fine particles and additives in the developer lowers the development performance. Narrowing the gap between a developer roller and a photoreceptor drum and raising an AC peak voltage (Vpp) are possible measures to enhance the development performance. These measures, however, cause leakage of an applied potential between the developer roller and the photoreceptor drum. The leakage of the applied potential adversely affects the development system that aims to shift only the sufficiently charged toner of the two-component developer onto the developer roller while keeping the carrier particles unmoved.

The object of the present invention is accordingly provide an image formation apparatus and an image formation method using the same, that effectively prevent leakage of an applied voltage between a developer roller and a photoreceptor drum in the process of developing an electrostatic latent image on the photoreceptor by means of a thin toner layer, which is formed on the surface of the developer roller by a magnetic brush comprising toner and carrier particles on the magnetic roller, so as to form an image.

SUMMARY OF THE INVENTION

In order to attain the above objects, the present inventors have found that a developer roller made of aluminum and coated with an aluminum oxide film is effective for preventing leakage of an applied voltage between the developer roller and a photoreceptor drum. The present inventors have also examined the effects of the varying gap between the aluminum oxide-coated developer roller and the photoreceptor drum on leakage of the applied voltage and have found that setting the gap in a range of 150 to 300 μm is significantly effective. It has also been found that the aluminum oxide film of at least 5 μm in thickness sufficiently prevents leakage of the applied voltage.

The present inventors have further found that sufficient effects of preventing attraction of carrier particles in a non-development state are exerted by regulating a frequency of AC voltage in the non-development state to be higher than that in a development state when an AC voltage is applied onto the developer roller to cause flight of toner from the developer roller to the photoreceptor.

The present invention has been completed through the intensive studies based on the above findings and is directed to the following image formation apparatuses and image formation methods given below.

(1) An image formation apparatus that develops an electrostatic latent image on a photoreceptor by means of a thin toner layer, which comprises forming on surface of a developer roller by magnetic brush comprising toner and carrier particles on the magnetic roller, so as to form an image, wherein the developer roller is made of aluminum and has an aluminum oxide film of at least 5 μm in thickness formed on surface thereof, and a gap between the developer roller and a drum of the photoreceptor is set in a range of 150 to 300 μm.

(2) The image formation apparatus according to (1), wherein the thickness of the aluminum oxide film is in a range of 10 to 20 μm, and the gap between the development roller and the drum of the photoreceptor is in a range of 150 to 280 μm.

(3) An image formation method that develops an electrostatic latent image on a photoreceptor by means of a thin toner layer, which is formed on surface of a developer roller by a magnetic brush comprising toner and carrier particles on the magnetic roller, so as to form an image, said image formation method comprising the steps of:

providing the developer roller that is made of aluminum and has an aluminum oxide film of at least 5 μm in thickness formed on surface thereof;

setting a gap between the developer roller and a drum of the photoreceptor in a range of 150 to 300 μm;

applying a DC voltage superposed with an AC voltage to said developer roller;

regulating a frequency of AC voltage in a non-development state so as to be higher than that in a development state; and selectively making charged toner fly onto the electrostatic latent image for development.

(4) The image formation method according to the above item (3), which comprises regulating a frequency in a range of 1 to 4 kHz in the development state.

(5) The image formation method according to the above item (3), which comprises regulating a frequency in a range of 1 to 3 kHz in the development state.

(6) The image formation method according to the above item (3), which comprises regulating a frequency in a range of 4 to 8 kHz in the non-development state.

(7) The image formation method according to the above item (3), which comprises regulating a frequency in a range of 5 to 8 kHz in the non-development state.

In the present invention, the thickness of the aluminum oxide film formed on the surface of the aluminum developer roller to prevent leakage of the applied voltage is not less than 5 μm but is preferably not less than 10 μm. The upper limit of the thickness is not specifically set, but 20 μm is sufficient. The greater thickness only increases the cost while exerting the similar effects.

The frequency of the AC voltage in the image formation state (the development state) is typically set to about 3 kHz, since the excessively high frequency causes ghost of development. This frequency setting in the non-development state, however, causes attraction of the carrier particles to shift the carrier particles from the magnetic brush formed on the magnetic roller onto the developer roller and further onto the photoreceptor drum. The image formation method of the present invention accordingly regulates the frequency in a range of 4 to 8 kHz in the non-development state to prevent the attraction of the carrier particles.

Figure 1:
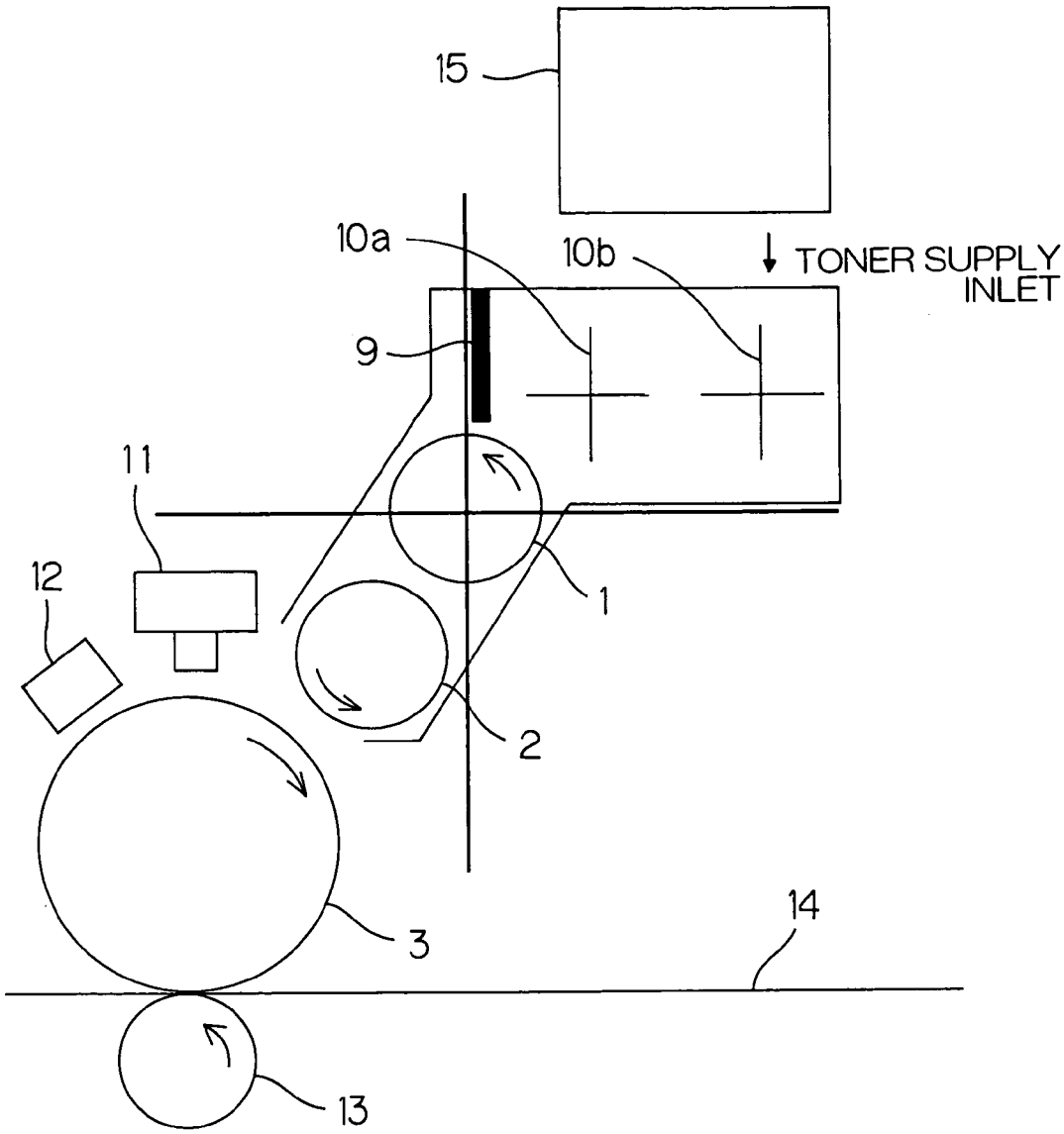
FIG. 1 illustrates an image formation apparatus of the present invention including a development process system.

Symbols in the drawings have the following meanings; 1: Magnetic Roller, 2: Developer Roller, 3: Photoreceptor Drum, 4: Carrier, 5: Toner, 9: Control Blade, 10*a*, 10*b*: Mixers, 11: Exposure Unit, 12: Charging Unit, 13: Primary Transfer Roller, 14: Print Medium, 15: Toner Container

DETAILED DESCRIPTION OF THE INVENTION

The structure of an image formation apparatus of the present invention including a development process system is discussed below with reference to FIGS. 1 and 2.

As illustrated in FIG. 1, the image formation apparatus has a photoreceptor 3 and a developer roller 2. A cylindrical magnetic roller 1 composed of a non-magnetic metal material is disposed to face the developer roller 2 across a predetermined gap. The magnetic roller 1 has multiple stationary magnets set in the cylinder and a sleeve designed to be rotatable around the stationary magnets.

The image formation apparatus also has paddle mixers 10*a* and 10*b*. Development bias voltages DC 7*a* and AC 7*b* are applied between the photoreceptor 3 and the developer roller 2, while a development bias voltage DC 8 is applied onto the magnetic roller 1 (see FIG. 2). A control blade 9 controls the thickness of magnetic brush, and in the present invention the gap between control blade 9 and the surface of magnetic roller 1 is regulated preferably in a range of 0.45 to 0.65 mm.

The operations of the photoreceptor 3 and the magnetic roller 1 and the developer roller 2 in the development process system are described below.

Figure 2:
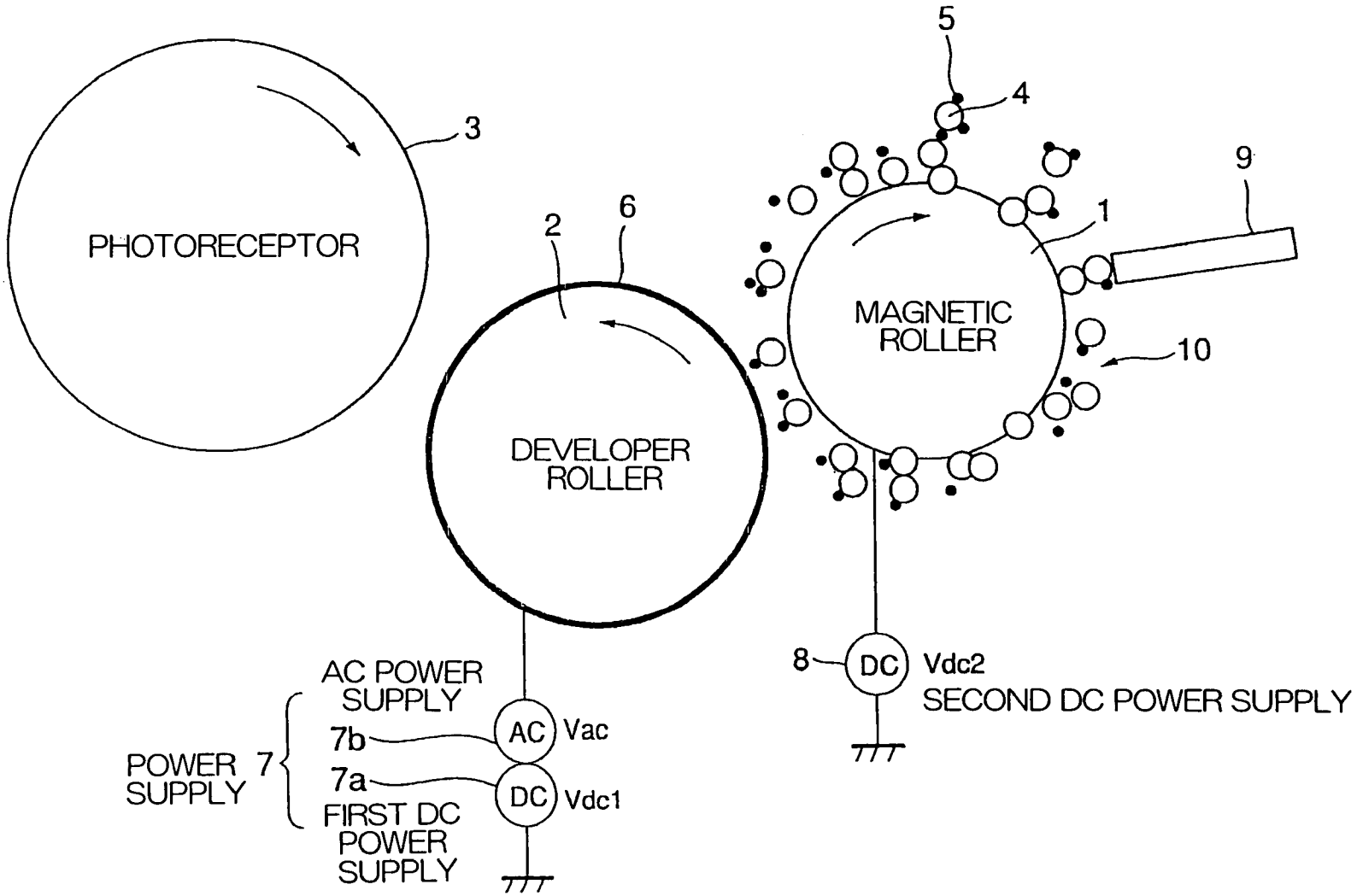
FIG. 2 shows flows of toner at an image formation timing and at a non-image formation timing.

As shown in FIG. 2, the magnetic roller 1 generates magnetic brush 10 of carrier particles 4 which charges the toner 5 carried thereon. The toner 5 supplied by the magnetic brush 10 forms a thin toner layer 6 on the surface of the developer roller 2. The photoreceptor 3 selectively flies the toner of the thin toner layer 6 according to an electrostatic latent image, so as to form an image. This image is transferred onto a print medium 14, which is conveyed between the photoreceptor 3 and a primary transfer roller 13. The diameter of the carrier particles 4 of the present invention is preferably in a range of 35 to 50 μm.

A positively-charged organic photoconductor (hereafter referred to as positive OPC), which has little emission of ozone and is stably charged, is favorably applied to the photoreceptor 3. Especially the positive OPC of single-layer structure is optimum for a long-life system, since it has little variation in photosensitive properties and ensures substantially constant picture quality even when the film thickness of the positive OPC varies over longtime use. Another available example is a-Si photoreceptor.

In the long-life system, it is advantageous to set the film thickness of the positive OPC in a range of 20 to 40 μm. When the film thickness of the positive OPC decreases and reaches 10 μm, dielectric breakdown causes the appearance of black dots in a resulting image. Setting the film thickness of not less than 20 μm is thus preferable. The film thickness of greater than 40 μm, however, undesirably lowers the sensitivity and may deteriorate the picture quality.

A system with a semiconductor laser or LED is preferably used for an exposure unit 11. The effective wavelength is about 770 nm for the positive OPC and about 685 nm for the a-Si photoreceptor. The following description regards an example with the positive OPC.

A charging unit 12 is activated to charge the positive OPC 3 as an electrostatic latent image holder to 400 V. The potential is set so that the voltage of 400 V is decreased to 70 V by exposure with an LED at a wavelength of 770 nm. The positive OPC 3 is disposed to face the developer roller 2 across a space of approximately 250 μm. The space does not have any wire electrode.

In the present invention, the developer roller 2 is a rotating body having an electrically conductive aluminum surface. The potential difference between the developer roller 2 and the magnetic roller 1 is utilized to form a thin toner layer on the surface of the developer roller 2. When the developer roller 2 has a potential of 70 V and the magnetic roller 1 has a potential of 400 V, a thin toner layer of about 1 to 1.5 mg/cm$^2$ is formed on the surface of the developer roller 2. The charging amount of the toner is adequately in a range of about 10 to 20 μC/g. The charging amount of less than 10 μC/g causes undesirable toner splash, while the charging amount of greater than 20 μC/g prevents the smooth flight of toner from the thin toner layer to the photoreceptor 3.

Application of an AC voltage to the developer roller 2 accelerates the flight of toner from the surface of the developer roller 2 to the photoreceptor 3 and exerts the favorable development effects. The preferable applied voltage is P–P=1.5 KV and f =3.0 kHz for the good balance of the image density, the dot reproducibility, and the removal of overlapping. Ghost appearance of development is suppressed effectively by setting the duty ratio to 30% which is for the duty ratio of AC voltage applied on the developing roller. The duty ratio is represented by the formula: a/(a+b)

(×100) %, wherein a is a time for applying the voltage so as to transfer toners to the photoreceptor side, and b is a time for applying the voltage so as to transfer toners the opposition side of the photoreceptor (i.e., the side of the developer roller).

The observed potential across the toner layer on the surface of the developer roller 2 is about 320 V. The actual working potential for development is thus 320−70 V (potential of the photoreceptor after the whole exposure)=250 V.

The gap between the magnetic roller land the developer roller 2 is generally set to approximately 400 μm. The gap between the control blade 9 and the magnetic roller 1 is adjusted according to the diameter of the carrier particles 4. For example, the gap is set in a range of 350 to 500 μm for the carrier particles 4 having the mean particle diameter of 35 μm and a developer containing 10% of the toner, where the magnetic brush is in contact with the developer roller 2. The excessively narrow gap between the developer roller 2 and the magnetic roller 1 prevents a smooth flow of the developer and causes its overflow. The excessively wide gap, however, prevents the magnetic brush from coming into contact with the developer roller 2 to collect the toner on the developer roller 2. Repeated development processes thus cause fixation of the toner onto the developer roller 2 and prevent the smooth flight of toner onto the photoreceptor 3.

In the present invention, the gap between the photoreceptor drum 3 and the developer roller 2 is set in a range of 150 to 300 μm. This gap is adjusted by taking into account leakage of an applied potential and the development performance. The narrower gap improves the development performance and well prevents increasing amount of the fine particles in the developer unit, thereby being advantageous for the long life. The excessively narrow gap, however, undesirably narrows the allowable margin for leakage of the applied potential.

The structure of the present invention adopts aluminum as the material of the developer roller 2 to prevent leakage of the applied potential and satisfy the good development performance. The aluminum development roller 2 is covered with an aluminum oxide film having a thickness of not less than 5 μm. The thickness of the aluminum oxide film is preferably not less than 5 μm and more specifically not less than 10 μm to effectively prevent leakage of the applied potential. The upper limit of the thickness for prevention of leakage of the applied potential is 20 μm. The greater thickness is cost-disadvantageous.

The image formation apparatus of the present invention applies an AC voltage onto the developer roller to cause the flight of toner from the developer roller to the photoreceptor drum, wherein the frequency of AC voltage in a non-development state is regulated so as to be higher than that in a development state of the electrostatic latent image. Here, the non-development state means: the time that is determined by excluding the developing time of electrostatic image from a period in which the developer roller is rotated and the photoreceptor drum is charged.

In this application process, the control regulates the frequency of AC current in a non-image formation state to be higher than that in an image formation state. Subsequently, the object of this development method is attained, wherein only the sufficiently charged toner of the two-component developer is moved to the developer roller while keeping the carrier particles unmoved. It is preferable to set the frequency of the AC voltage in a range of 1 to 4 kHz, more preferably 1 to 3 kHz, in the image formation state and in a range of 3.5 to 8 kHz, more preferably 3.5 to 7 kHz in the non-image formation state. In a concrete example, the frequency of the AC voltage is set to 4 to 8 kHz when the DC voltage applied to the developer roller is not higher than 100 V in the non-image formation state, while being set to be 5 to 8 kHz when the DC voltage applied to the developer roller is in a range of 100 to 200 V.

A known method may be applied to form an aluminum oxide film on the surface of the aluminum developer roller. The method electrolyzes the aluminum roller as the anode in an acid bath like sulfuric acid, oxalic acid, or chromic acid. Oxygen produced on the anode forms a porous aluminum oxide film having the high electric insulation performance, the high corrosion resistance, and the high wear resistance on the surface of the aluminum roller.

EXAMPLES

The present invention is discussed more in detail with reference to an example. This example is only illustrative and not restrictive in any sense.

Examples 1 to 9 and Comparative Examples 1 to 4:

In the structure of the development process system shown in FIG. 1, the gap between the photoreceptor drum and the developer roller 2 was set equal to 180 μm. A DC voltage applied onto the developer roller was set to 100 V, and Vpp (a voltage difference between the maximum voltage and the minimum voltage under the application of an AC voltage) was 1.4 to 1.7 kV. The frequency was regulated to 3 kHz in the development (image formation) state and 6 kHz in the non-development (non-image formation) state. An aluminum oxide film was formed on the surface of the aluminum developer roller 2 according to the known method mentioned above.

Table 1 shows the number of leak points on the sheet surface in the case of successive feed of 10 sheets with blank images against the thickness of the aluminum oxide film. Here the leak points were measured by counting the number of leak points on the sheet surface after successive feed of 10 sheets with blank images. The developing system was operated under the following condition:

The rotation speed of the photoreceptor drum 3: 100 mm/s, the rotation speed of the developer roller 2: 150 mm/s, and the rotation speed of the magnetic roller 1: 225 mm/s. The toner concentration in the developing agent was controlled so as to keep 10%.

TABLE 1

| Thickness of Aluminum Oxide | Leak points (10 sheets with blank images) | | | |
|---|---|---|---|---|
| film (μm) | 1.4 kV | 1.5 kV | 1.6 kV | 1.7 kV |
| 0 | 35 | 46 | 58 | 84 |
| 5 | 0 | 2 | 2 | 5 |
| 10 | 0 | 0 | 0 | 0 |
| 15 | 0 | 0 | 0 | 0 |
| 20 | 0 | 0 | 0 | 0 |

These results show that formation of the aluminum oxide film on the aluminum roller effectively prevent appearance of the leakage. The aluminum oxide film of 5 μm in thickness prevented the leakage up to Vpp of 1.5 kV, but caused leakage at Vpp of or over 1.6 kV. The aluminum oxide film having the thickness of or over 10 μm sufficiently prevented the leakage at the practical working voltage of 1.4 kV to 1.7 kV.

Next, Table 2 shows the relationship of the gap (space) between the photoreceptor drum 3 and the developer roller 2 and appearance of the leakpoints, wherein the experiments were carried out under the same condition as shown in Table 1 except that the thickness of aluminum oxide film was adjusted to 10 μm and Vpp was adjusted to 1.7 kV.

When the gap was adjusted to 130 μm, 12 of leak points were observed even the thickness of aluminum oxide film was adjusted to 20 μm and Vpp was adjusted to 1.4 kV, and therefore it is shown that the gap is required to be not less than 150 μm in order to prevent appearance of the leak points. When the gap was adjusted to 320 μm, the image concentration lowered to 1.24 that is lower than 1.30 of the determined concentration. Therefore, it is shown that the gap is required to be no more than 300 μm in order to keep the image concentration to the determined concentration. Here, the image concentration was measured by Reflection Densitometer RD-918 (Macbeth).

TABLE 2

| Gap (μm) | Observing |
|---|---|
| 130 | Appearance of leak points (*1) |
| 170 | Good |
| 220 | Good |
| 270 | Good |
| 320 | Poor in Image (*2) |

(*1) Ten leak points were observed even when the thickness of oxide film is adjusted to 20 μm and Vpp is 1.4 KV.
(*2) The image concentration was 1.24 that is not more than 1.3 of the defined value and the reproducibility of line image was become worse.

Table 3 shows the relationship between a frequency of an AC voltage applied to the developer roller in the image formation (development) state and the image quality. The experiments were carried out under the condition of the thickness of aluminum oxide film: 20 μm, the gap between the photoreceptor drum 3 and the developer roller 2: 180 μm, Vpp of AC voltage: 1.6 kV and the frequency of AC voltage applied to the developer roller in non-developing state: 6 kHz.

TABLE 3

| In Developing | Co. Ex. 1 | Ex. 1 | Ex. 2 | Ex. 3 | Ex. 4 | Co. Ex. 2 |
|---|---|---|---|---|---|---|
| | Frequency (kHz) | | | | | |
| Slv-DC | 0.5 | 1.5 | 2.0 | 3.0 | 4.0 | 5.0 |
| 50 | X (1.11) | ○ | ○ | ○ | Δ | X |
| 100 | X (1.17) | ○ | ○ | ○ | Δ | X |
| 150 | X (1.22) | ○ | ○ | ○ | Δ | X |
| 200 | X (1.25) | ○ | ○ | ○ | Δ | X |

Co. Ex.: Comparative Example
Ex.: Example
X: Ghost is clearly observed under eye-looking or the image concentration is less than 1.30.
Δ: Ghost is slightly observed under eye-looking or the image concentration is 1.30 to 1.35.
○: Good (Image concentration is more than 1.3 and ghost is not observed under eye-looking.)

From the results of Table 3, when the frequency was 0.5 kHz the image concentration lowered to no more than 1.30 of the defined value, when the frequency was 4.0 kHz the ghost image was appeared, when the frequency was 5 kHz the ghost image was frequently appeared in spite of applying a DC voltage to the developer roller. Therefore, it is shown that the AC frequency in developing state is preferably in the range of 1 to 4 kHz and more preferably in the range of 1 to 3 kHz. Here, the evaluation of ghost image was carried out so that a halftone image in the length of paper transferring direction is longer than that of image formation of all black color and the space between the extreme points of all black color image and the halftone image is set to the circle length of the developer roller 2. Appearance of the ghost image can be judged on whether unnecessary image of black shade state in the halftone image is appeared.

Table 4 shows the attraction of carrier particles with a variation in frequency of the DC voltage applied to the developer roller in the non-image formation (non-development) state. Here, the experiments were carried out by the same condition as in Table 3 except that frequency of AC voltage applied to the developer roller in image formation state was 3 kHz. The evaluations are carried out by forming toner image on sheet in 5% printing ratio under printing of ten thousand sheets. Carrier particles were evaluated in the carrier amount that is contained in the discard toner recovered from the photoreceptor drum by cleaning apparatus.

TABLE 4

| In Developing | Co. Ex. 3 | Ex. 5 | Ex. 6 | Ex. 7 | Ex. 8 | Ex. 9 | Co. Ex. 4 |
|---|---|---|---|---|---|---|---|
| | Frequency (kHz) | | | | | | |
| Slv-DC | 3.5 | 4.5 | 5.5 | 6.5 | 7.0 | 8.0 | 9.0 |
| 50 | X | ○ | ○ | ○ | ○ | ○ | X2 |
| 100 | X | ○ | ○ | ○ | ○ | ○ | X2 |
| 150 | X | Δ | ○ | ○ | ○ | ○ | X2 |
| 200 | X | Δ | ○ | ○ | ○ | ○ | X2 |

X: Carrier particles are not less than 1.5 g.
Δ: Carrier particles are not less than 0.5 g and less than 1.5 g.
○: Carrier particles are under 0.5 g.
X2: lowering of image concentration (not attained to 1.30 of the determined value after printing of ten thousand sheets).

Here, the amount of developing agent was 220 g and the life of the developer was set to printing of 200 thousand sheets.

From the results of Table 4, the attraction of carrier particles was sufficiently prevented at the frequency of higher than 4.0 kHz when the DC bias voltage applied onto the developer roller was lower than 100 V in the non-development state and at the frequency of higher than 5.0 kHz when the DC bias voltage applied was in a range of 100 to 200 V. Further, since the removal of toner from the developer roller 2 was decreased in non-developing state when the frequency was over 8 kHz. For this reason, the fine toner which is not good for developing is increased on the developer roller when continuous printing was conducted and accordingly the electrostatic latent image is hard to be developed. When printing is continued under the above situation, the image forming concentration is decreased. In each case of the present Examples, for example, the image concentration after printing of ten thousand sheets was less than 1.30 that is the predetermined value.

EFFECTS OF THE INVENTION

The present invention provides the effective development technique to prevent leakage of an applied voltage between a developer roller and a photoreceptor drum in an image formation apparatus that develops an electrostatic latent image on the photoreceptor by means of a thin toner layer, which is formed on the surface of the developer roller via toner on a magnetic roller and magnetic brush of carrier particles, so as to form an image.

The disclosure of Japanese Patent Application Serial No.2003-102039 filed on Apr. 4, 2003 and No. 2004-076543 filed on Mar. 17, 2004, is incorporated herein by reference.

What is claimed is:

1. An image formation method that develops an electrostatic latent image on a photoreceptor by means of a thin toner layer, which is formed on surface of a developer roller via toner of a magnetic roller and magnetic brush of carrier particles, so as to form an image, said image formation method comprising the steps of:

providing the developer roller that is made of aluminum and has an aluminum oxide film of at least 5 μm in thickness formed on surface thereof;

setting a gap between the developer roller and a drum of the photoreceptor in a range of 150 to 300 μm;

applying a DC voltage superposed with an AC voltage to said developer roller;

regulating a frequency of AC voltage in a non-development state to be higher than that in a development state; and selectively making charged toner fly onto the electrostatic latent image for development.

2. The image formation method according to claim 1, which comprises regulating a frequency in a range of 1 to 4 kHz in the development state.

3. The image formation method according to clam 1, which comprises regulating a frequency in a range of 1 to 3 kHz in the development state.

4. The image formation method according to claim 1, which comprises regulating a frequency in a range of 4 to 8 kHz in the non-development state.

5. The image formation method according to claim 1, which comprises relating a frequency in a range of 5 to 8 kiHz in the non-development state.

* * * * *